US008191335B2

(12) United States Patent
Davis

(10) Patent No.: US 8,191,335 B2
(45) Date of Patent: Jun. 5, 2012

(54) FRAMING GUIDE

(76) Inventor: Mark Kevin Davis, Castle Rock, CO (US)

( * ) Notice: Subject to any disclaimer, the term of this patent is extended or adjusted under 35 U.S.C. 154(b) by 192 days.

(21) Appl. No.: 12/723,639

(22) Filed: Mar. 13, 2010

(65) Prior Publication Data

US 2011/0219724 A1 Sep. 15, 2011

(51) Int. Cl.
*E04B 1/38* (2006.01)

(52) U.S. Cl. ..... 52/749.1; 33/613; 33/645; 52/653.1; 52/745.09

(58) Field of Classification Search ..... 52/749.1, 52/745.09, 220.1, 715; 33/613, 645, 194, 33/562, 566

See application file for complete search history.

(56) References Cited

U.S. PATENT DOCUMENTS 3,458,184 A * 7/1969 Schlosser ..... 269/287
3,738,013 A * 6/1973 Gregory ..... 33/197
3,834,033 A * 9/1974 Pinkard ..... 33/563
4,489,500 A * 12/1984 Valat ..... 33/394
5,367,783 A * 11/1994 Nygren ..... 33/613
5,509,207 A * 4/1996 Harms ..... 33/41.4
5,688,428 A * 11/1997 Maguire ..... 249/91
5,768,795 A * 6/1998 Jimenez ..... 33/613
6,293,028 B1 * 9/2001 Sylvia ..... 33/613
6,381,908 B1 * 5/2002 Fisher ..... 52/127.2
6,385,859 B1 * 5/2002 Varney ..... 33/613
6,663,069 B1 * 12/2003 Norberg ..... 248/316.7
6,775,916 B2 * 8/2004 Sparkes ..... 33/613
6,843,035 B1 * 1/2005 Glynn ..... 52/573.1
6,895,684 B1 * 5/2005 Firth ..... 33/613
6,935,041 B2 * 8/2005 Orton ..... 33/613
7,028,446 B2 * 4/2006 Winchester ..... 52/746.1
7,168,219 B2 * 1/2007 Elderson ..... 52/667
2002/0000076 A1 * 1/2002 Goeku ..... 52/653.1
2008/0110107 A1 * 5/2008 Decker ..... 52/127.2
2009/0056258 A1 * 3/2009 Currier ..... 52/348

* cited by examiner

*Primary Examiner* — Basil Katcheves
*Assistant Examiner* — Beth Stephan
(74) *Attorney, Agent, or Firm* — Paul D. Chancellor; Ocean Law

(57) ABSTRACT

A multi-sided framing guide includes a stud side with stud pockets, a nail side with nailing windows, and an intermediate side adjoining the stud and nail sides.

9 Claims, 9 Drawing Sheets

FRAMING GUIDE

BACKGROUND OF THE INVENTION

1. Field of the Invention

The present invention relates to a construction tool. In particular, a framing guide provides a means for improved construction, including improved wall construction.

2. Discussion of the Related Art

Construction using framing members is an old art. Over hundreds of years, the tools, materials, and methods used for framing structures have improved. Despite these improvements, framing tools used today are little changed from those used hundreds of years ago. The most significant improvements relate primarily to mechanizing a well known tool, such as substituting a nail gun for a hammer and nail.

SUMMARY OF THE INVENTION

A framing tool comprises a guide used to align a horizontal framing member with a vertical framing member and to facilitate fastening the members together while maintaining the desired relative alignment.

In an embodiment, an elongated framing guide has a stud side coupled to an opposed nail side by an intermediate side. The stud side, intermediate side, and nail side form a substantially "n" shaped guide cross section with an elongated slot. The elongated slot is for receiving a horizontal framing member.

The stud side includes a plurality of pockets for receiving respective ends of vertical framing members and each pocket has three sides formed to position opposing major sides of the vertical framing member about perpendicular to the intermediate side. A leveling device is located between each pair of adjacent pockets and is arranged to indicate a level of the guide.

The nail side includes a plurality of nailing windows and each nailing window is generally opposed to a respective stud side pocket.

The intermediate side includes a plurality of insets, each inset located between an adjacent pair of the stud side pockets. Each inset has a surface depressed with respect to the intermediate side and about parallel to the intermediate side and a plurality of the depressed surfaces have respective leveling devices, each leveling device located between an adjacent pair of pockets and arranged to indicate a level of the guide. The intermediate side further includes a plurality of viewing windows, each viewing window for exposing a junction between a vertical framing member and the horizontal framing member.

The guide is movable along an upper horizontal framing member of arbitrary length for aiding alignment and fixation of vertical framing members with the upper horizontal framing member. In addition, the guide is movable along an associated lower horizontal framing member for aiding alignment and fixation of the vertical framing members with the lower horizontal framing member.

BRIEF DESCRIPTION OF THE DRAWINGS

The present invention is described with reference to the accompanying figures. These figures, incorporated herein and forming part of the specification, illustrate embodiments of the invention and, together with the description, further serve to explain its principles enabling a person skilled in the relevant art to make and use the invention.

DETAILED DESCRIPTION OF THE PREFERRED EMBODIMENTS

The disclosure provided in the following pages describes examples of some embodiments of the invention. The designs, figures, and description are non-limiting examples of the embodiments they disclose. For example, other embodiments of the disclosed device and/or method may or may not include the features described herein. Moreover, disclosed advantages and benefits may apply to only certain embodiments of the invention and should not be used to limit the disclosed invention.

Figure 1A:
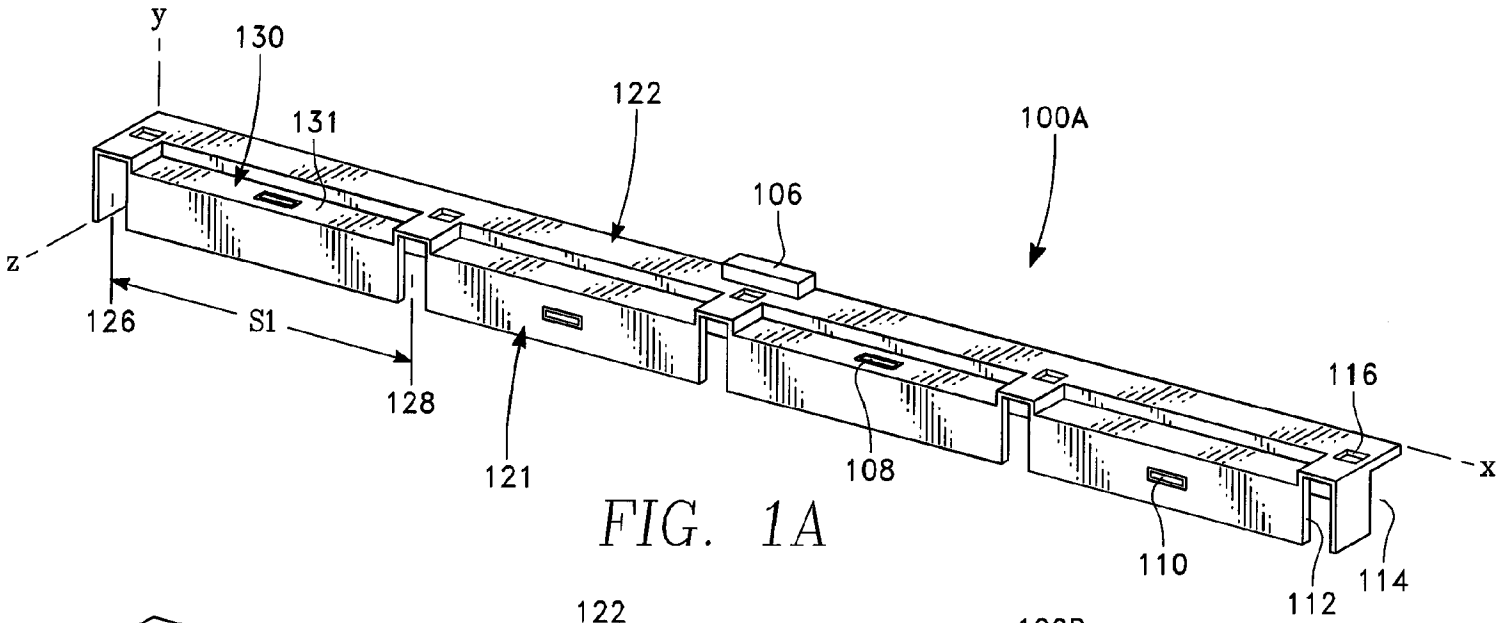
FIG. 1A shows a first view of a framing guide in accordance with the present invention.
Figure 1B:
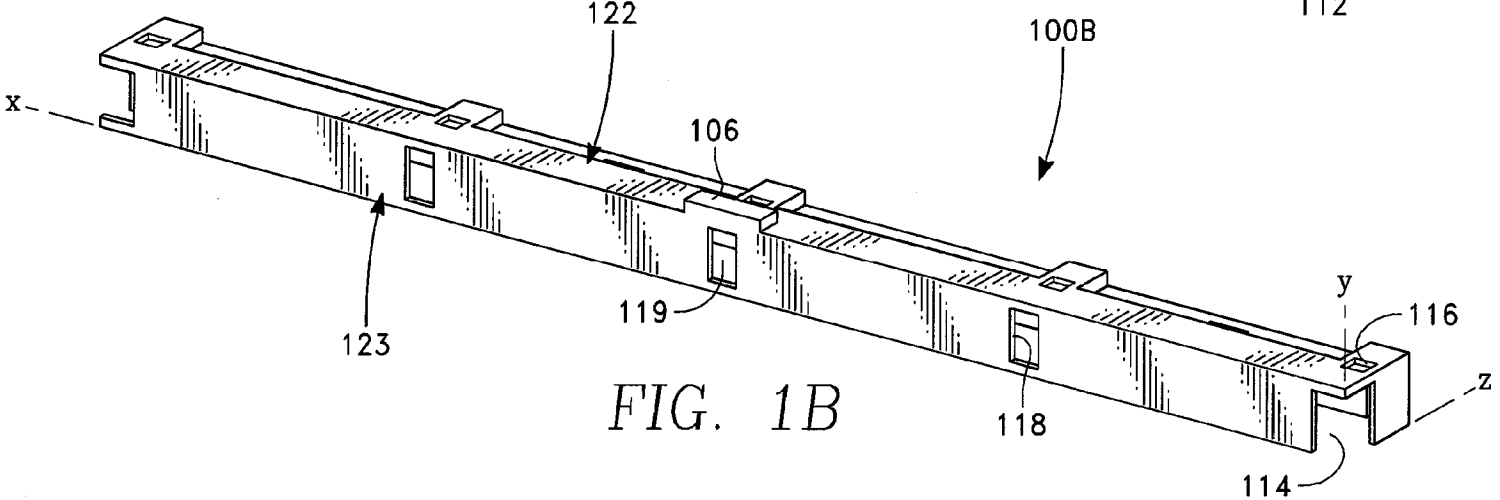
FIG. 1B shows a second view of the framing guide of FIG. 1A.
Figure 1C:
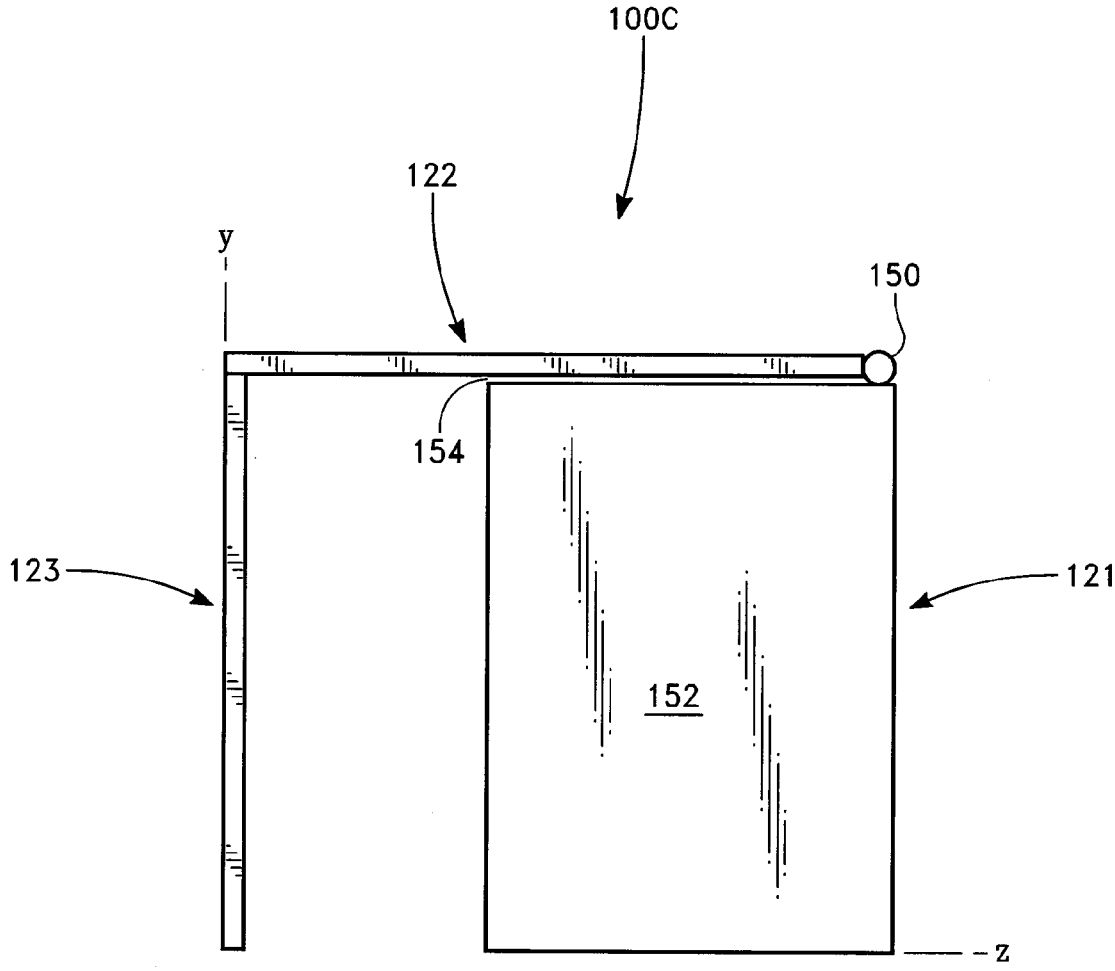
FIG. 1C shows hinged embodiment of the framing guide of FIG. 1A.

FIG. 1A shows a first view of a framing guide in accordance with an embodiment of the present invention 100A. FIG. 1B shows a second view of the framing guide 100B. The first view of the guide shows a guide stud side 121 and a guide intermediate side 122. A second view of the guide 100B shows a guide nail side 123 and the guide intermediate side. The guide has a generally "n" shaped cross-section formed by the stud side, intermediate side, and nail side. FIG. 1C shows a framing guide embodiment having an articulated joint 100C.

Figure 2:
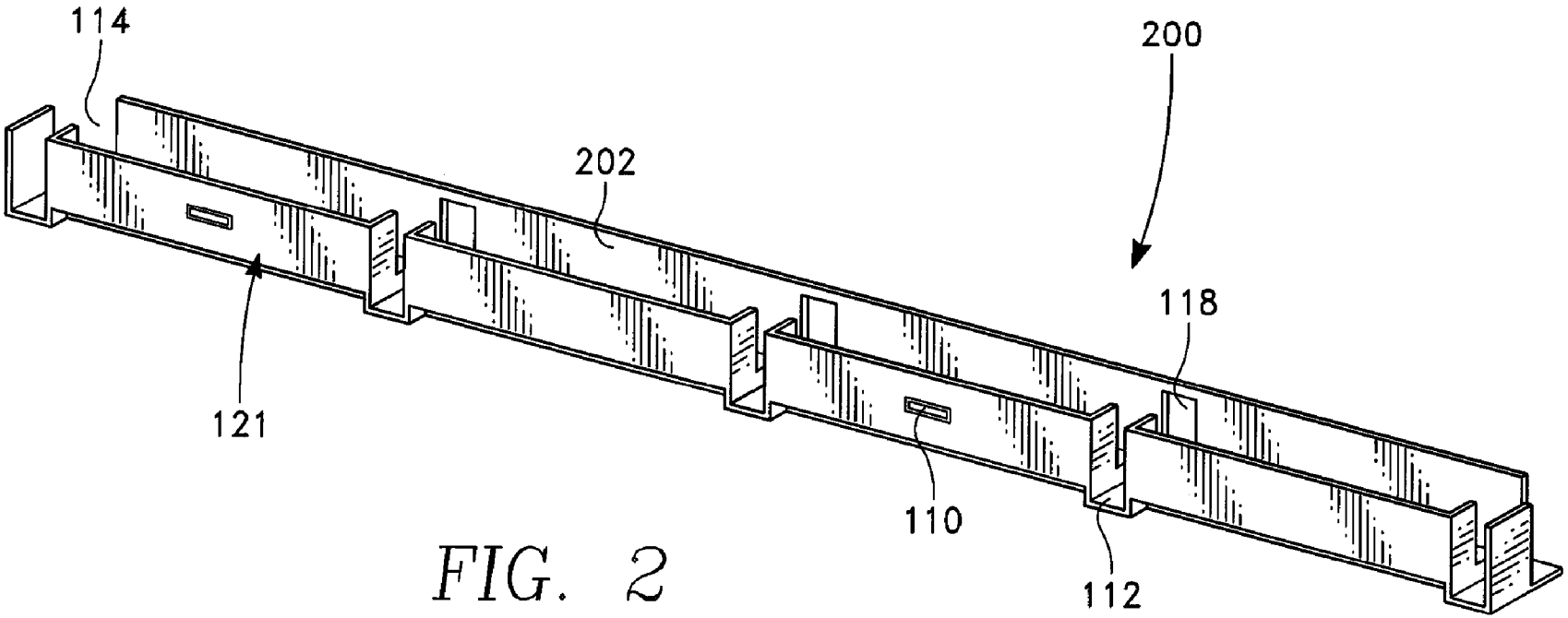
FIG. 2 shows another view of the framing guide of FIG. 1A.

FIG. 2 shows an axially rotated view of the guide 200. In the axially rotated view, the open side of the "n" shaped guide 202 is visible.

Figure 3:
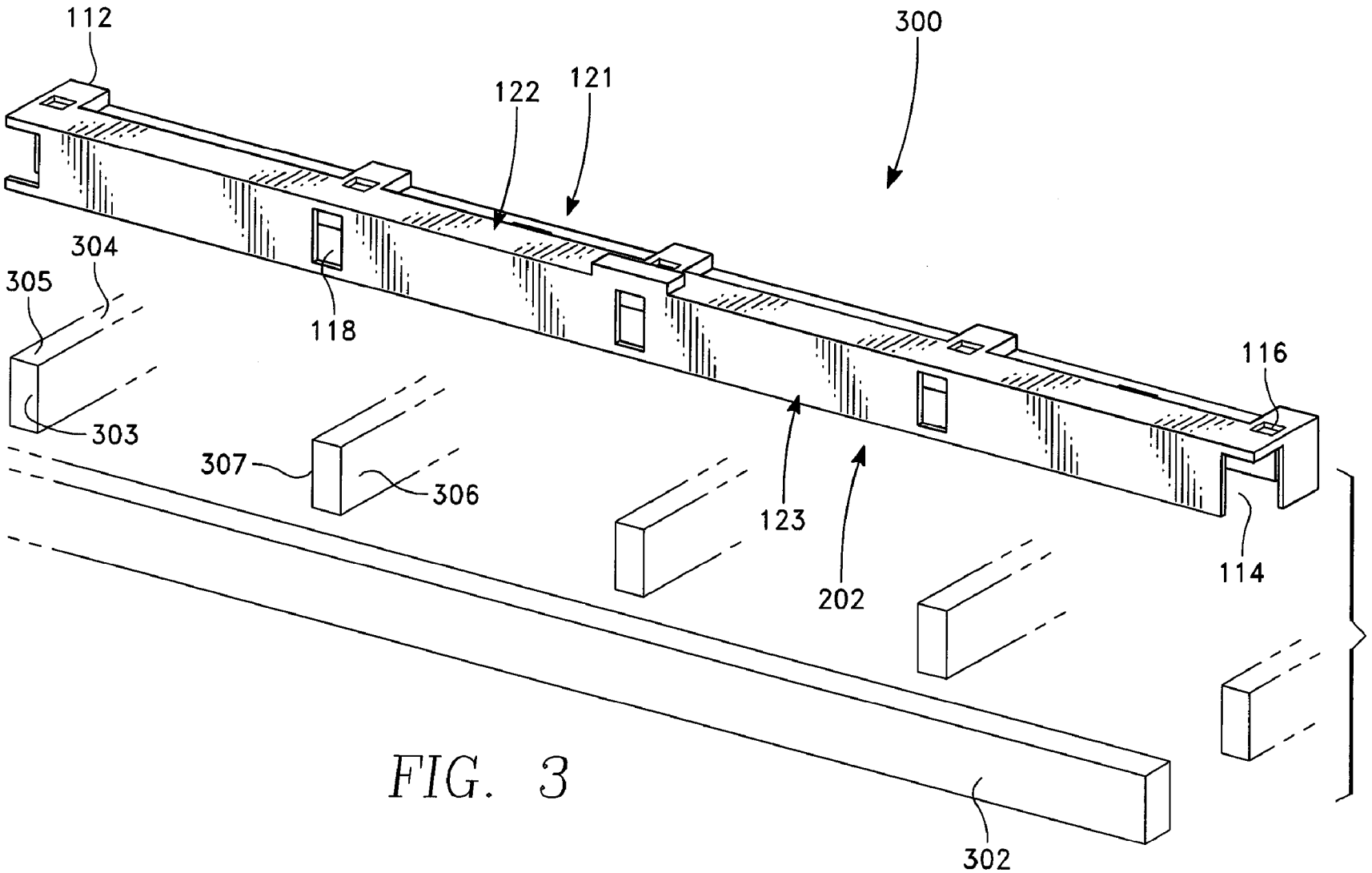
FIG. 3 shows the framing guide of FIG. 1A alongside framing members to be assembled using the guide.

FIG. 3 shows the guide and framing members to be joined 300. The framing members include a horizontal framing member 302 and a plurality of vertical framing members or studs 304.

An orthogonal coordinate system with an origin at a lower, back, left corner of the guide as shown in the first view 100A places the stud side 121 in a plane parallel to the x-y plane, the nail side 123 in a plane parallel to the x-y plane, the intermediate side 122 in a plane parallel to the x-z plane, and the open side 202 in a plane parallel to the x-z plane.

Stud pockets 112 are arranged along the stud side 121 of the framing guide. In an embodiment, the framing guide has five stud pockets (as shown). Some embodiments utilize less than five stud pockets while other embodiments utilize more than five stud pockets. Each stud pocket has three sides formed to position opposing major sides of the studs 306, 307. Spacing between the stud pocket centerlines 126, 128 is set to create a desired stud spacing S1 such as 12 inches on center, 18 inches on center, or another desired spacing.

Figure 4A:
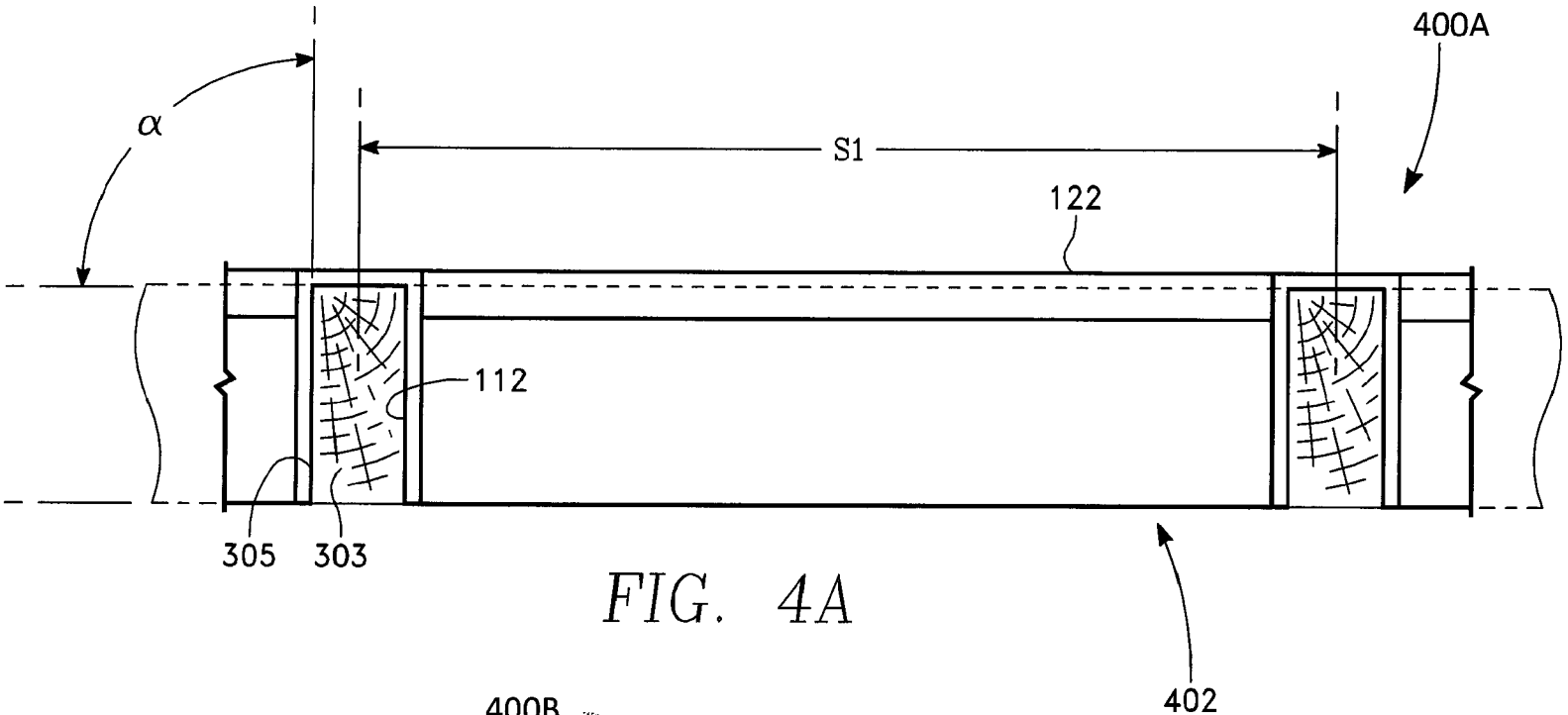
FIG. 4A shows a cross-section of a first selected portion of the guide of FIG. 1A.
Figure 4B:
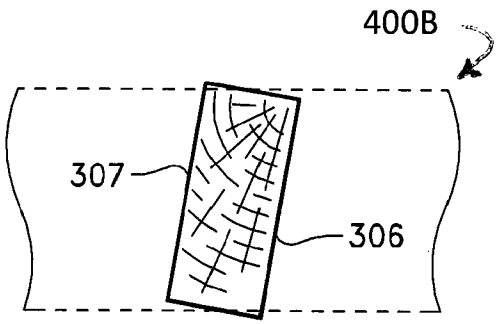
FIG. 4B shows a cross-section of a second selected portion of the guide of FIG. 1A.

FIGS. 4A and 4B show framing guide cross-sections along a plane parallel to the x-y plane 400A, 400B. The stud ends 305 are inserted in the stud pockets 112. As can be seen in the first view 402, the framing guide aligns the stud major sides 306, 307 about perpendicular to the intermediate side 122. In contrast, assembly without the framing guide often leads to misaligned studs as shown in the second view 400B.

In an embodiment, one or more bubble tube type levels 108 are fixed to the intermediate side 122 between adjacent stud pockets 112 (as shown). These levels lie along a line parallel to the x axis and are referred to as x-z levels. In some embodiments, one or more bubble type levels 110 are fixed to the stud side 121 between adjacent stud pockets 112 (as shown). These levels lie along a line parallel to the x axis and are referred to as x-y levels.

In an embodiment, adjacent stud pockets 112 are separated by insets 130 (as shown). Here, each inset has a surface 131 depressed with respect to the intermediate side 122 and about parallel to the intermediate side. Where the framing guide material is chosen for properties other than strength and rigidity, such as in the choice of a light weight polymeric or plastic material, the use of insets improves the rigidity of the guide.

Nailing windows 118 are arranged along the nail side 123 of the framing guide. In an embodiment, the framing guide has five nailing windows (as shown). Nailing windows correspond to stud pockets 112 as further described below. Each nailing window provides an opening into the interior of the framing guide 119 that aligns with a respective stud pocket and stud face 303.

An elongated slot 114 along the length of the framing guide is for interengaging a horizontal framing member 302. One side of the slot is bounded by the framing guide's nail side 123 and an adjacent side of the slot is bounded by the framing guide's intermediate side 122.

In an embodiment, viewing windows 116 are arranged along the intermediate side of the framing guide. The viewing windows are aligned with the stud pockets 112. When the framing guide interengages a horizontal framing member 302 and a stud 304, the corresponding viewing window enables a user to view the junction where the stud meets the horizontal framing member. Visual assessments of these junctions enables a user to assure, among other things, that a stud is fully inserted in a respective stud pocket 112.

Some framing guide embodiments provide a hand-hold means to facilitate handling the guide. In one embodiment, a hand hold 106 extends from the intermediate side 122 about midway between the ends of the framing guide. And, some framing guide embodiments provide a hinge 150 (See FIG. 1B) coupling the stud and intermediate sides 121, 122, rotation of the stud side with respect to the intermediate side being useful for facilitating sliding the guide along a horizontal framing member. In a hinged embodiment, end walls 152 are separated from the intermediate side by a gap 154 enabling rotation of the end walls and stud side with respect to the intermediate side.

In various embodiments, the framing guide is made of one or more materials that provide the desired combination of strength, rigidity, light weight, manufacturability, and toughness. Non-metal materials include polymers such as plastics, composites such as carbon composites, and fabric with resin composites such as fiberglass. Metals include ferrous and non-ferrous metals such as steel, aluminum, titanium, and alloys of these metals known to persons of ordinary skill in the art.

In operation, the framing guide is used to align a horizontal framing member 302 with a plurality of vertical framing members 304, and to facilitate fastening the members together.

Figure 5A:
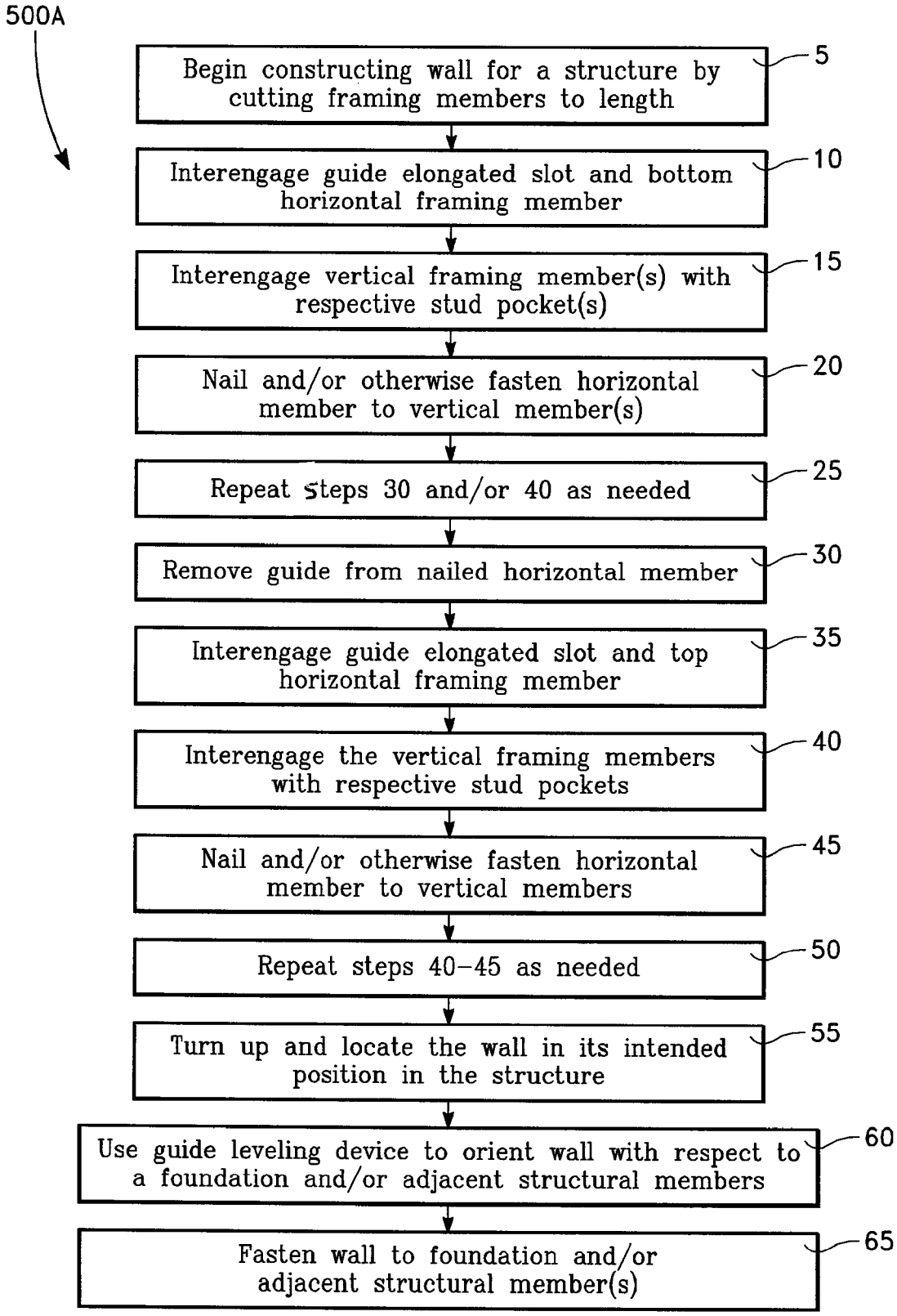
FIG. 5A shows a first flowchart depicting an exemplary method of using the guide of FIG. 1A.
Figure 5B:
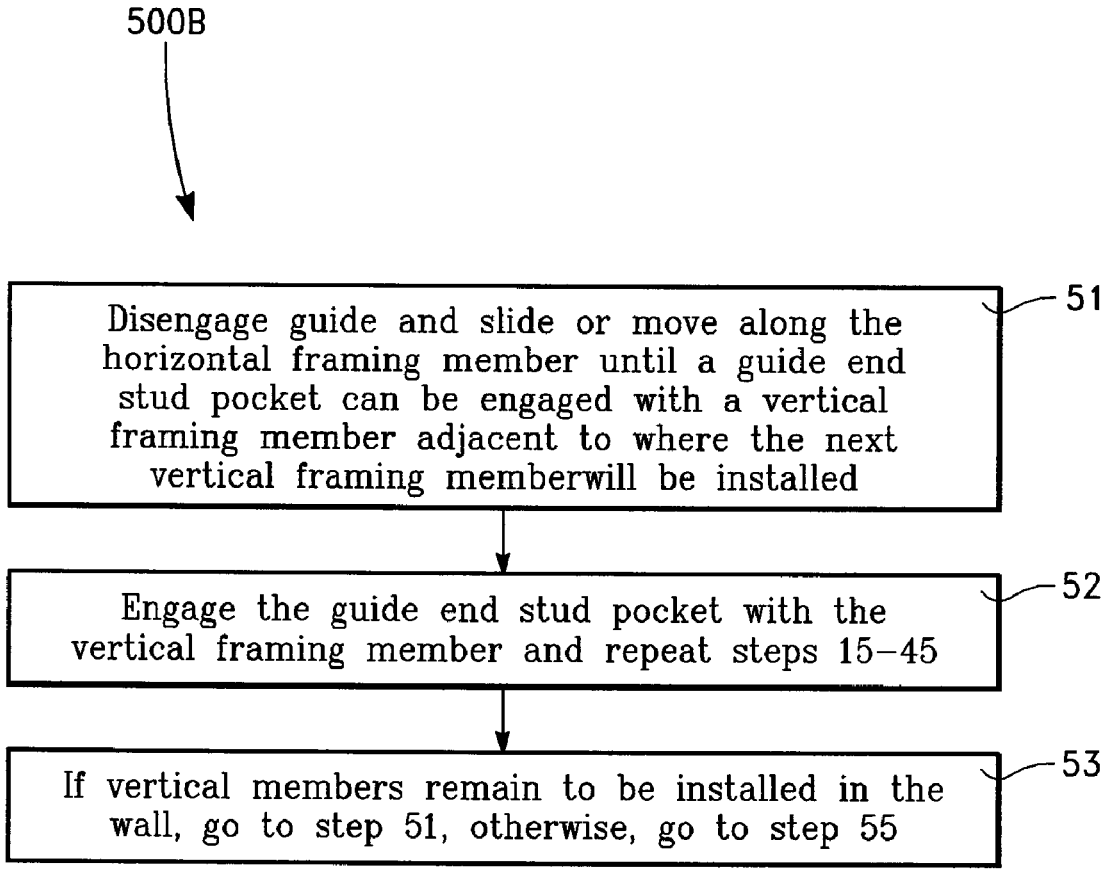
FIG. 5B shows a second flowchart depicting an exemplary method of using the guide of FIG. 1A.

FIGS. 5A and 5B show exemplary method flowcharts using the framing guide 500A, 500B. The method steps may be in the sequence shown, or in another sequence and fewer than all of the steps may be used in various embodiments. Moreover, other steps may be included as will be understood by a person of ordinary skill in the art.

Figure 6A:
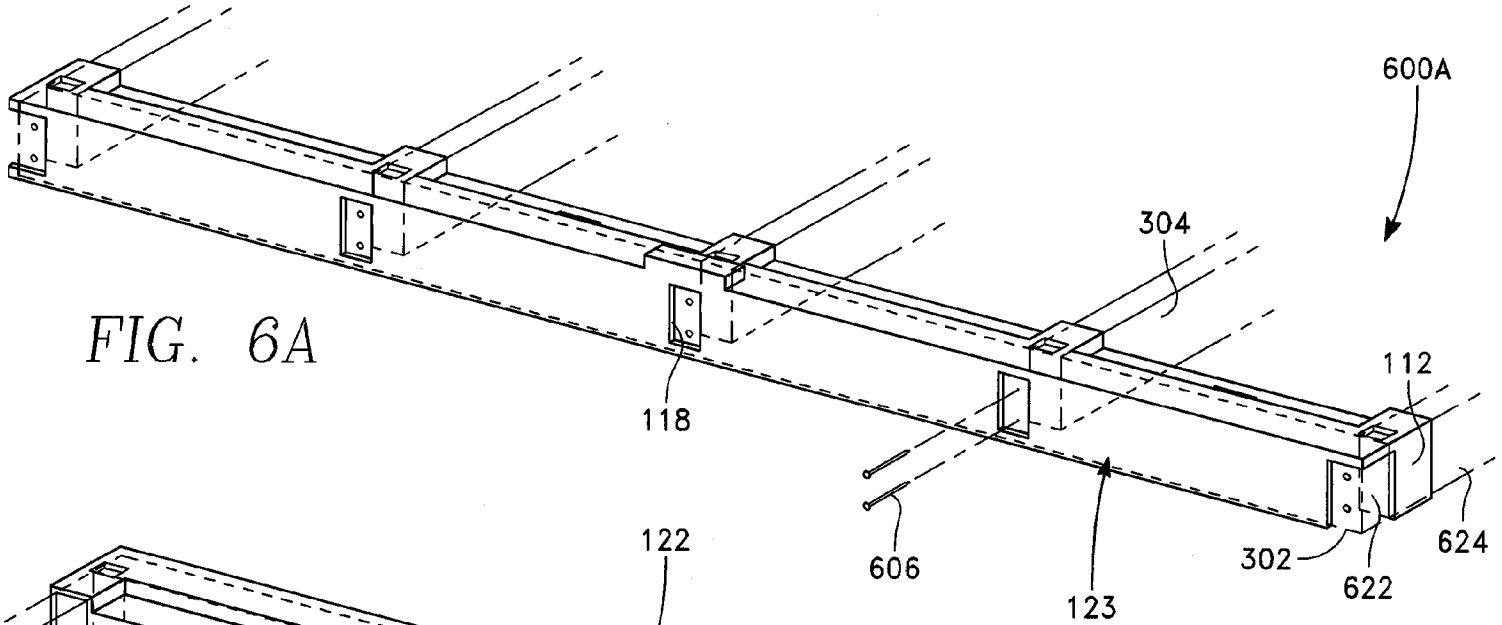
FIG. 6A shows a first construction of a wall section using the guide of FIG. 1A.
Figure 6B:
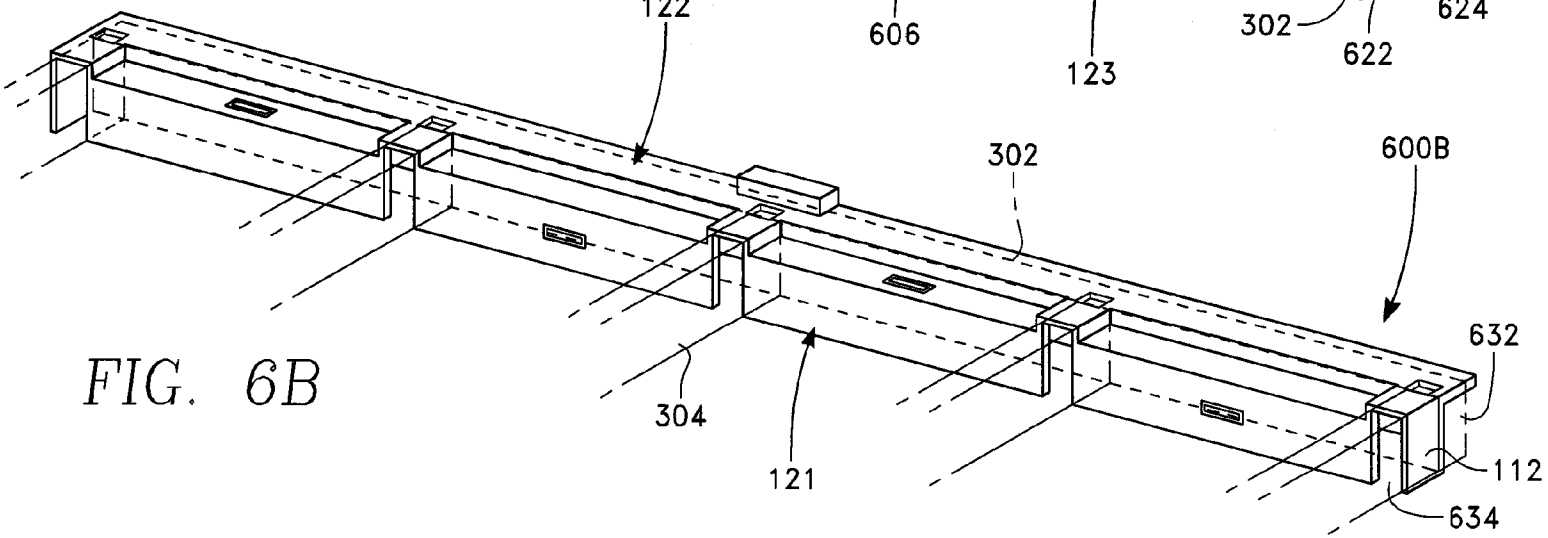
FIG. 6B shows a second construction of a wall section using the guide of FIG. 1A.
Figure 7:
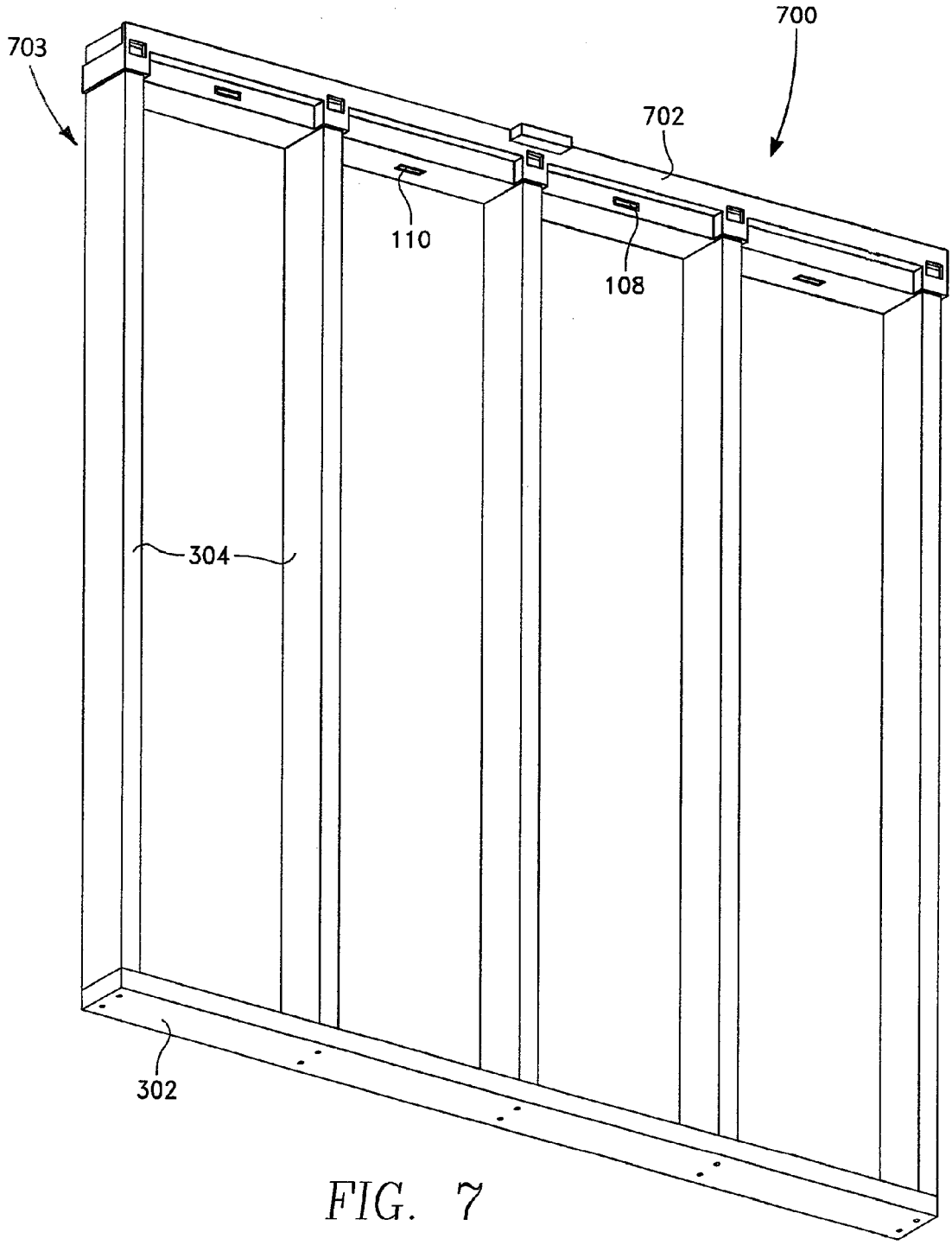
FIG. 7 shows placement and leveling of a wall section using the guide of FIG. 1A.

FIGS. 6A, 6B show the framing guide in use during wall section construction 600A, 600B. View 600A shows fastening of a bottom horizontal member 622 and view 600B shows fastening of a top horizontal member 632. FIG. 7 shows the framing guide in use during wall section placement 700. The framing guide 702 is located atop the wall section 703 and levels 108, 110 are available for leveling of the wall section.

In the exemplary sequence of method steps, beginning with step 5, a wall is constructed using the framing guide 300. Framing members are selected and cut to length as needed 300. Continuing with step 10, the guide elongated slot 114 is interengaged with a bottom horizontal framing member 612. Continuing with step 15, vertical framing members are interengaged with respective stud pockets 624. Continuing with step 20, fasteners such as nails, screws, staples, or another fastener known to persons of ordinary skill in the art are used to fasten the horizontal member to the vertical members 606 via the nailing windows 118. Continuing with step 25, steps 15 and/or 20 are repeated as needed to fasten each vertical framing member to the horizontal framing member.

Continuing with step 30, when the studs 304 in the framing guide are fastened to the bottom horizontal member 622, the framing guide is removed from the fastened framing members and, continuing with step 35, the framing guide elongated slot is interengaged with a top horizontal framing member. Continuing with step 40, the opposite ends of the vertical framing members interengaged with respective stud pockets 634. Continuing with step 45, fasteners such as nails, screws, staples, or another fastener known to persons of ordinary skill in the art are used to fasten the horizontal member to the vertical members 606 via the nailing windows 118. Continuing with step 50, steps 40 and/or 45 are repeated as needed to fasten each vertical framing member to the horizontal framing member.

Continuing with step 55, when the studs 304 in the framing guide are fastened to the top horizontal member 632, the constructed wall 700 is turned up and located in its intended position in a structure. Continuing with step 60, the leveling devices 108, 110 are used to orient the wall with respect to a foundation and/or adjacent structural members. Continuing with step 65, when the wall is positioned and leveled as desired, the wall is fastened to the foundation and/or adjacent structural members.

In an embodiment, the framing guide is used to construct a wall section incorporating more studs than can be placed in the framing guide at one time. Here, the framing guide is moved along a horizontal framing member to incorporate additional studs. An exemplary method incorporates additional steps 51, 52, and 53 between steps 50 and 55.

After step 45 disengage the guide and slide or move it along the horizontal framing member until a guide end stud pocket can be engaged with a vertical framing member adjacent to where the next framing member will be installed 51. Engage the guide end stud pocket with the vertical framing member and repeat steps 15-45. If vertical members remain to be installed in the wall, go to step 51; otherwise, as directed in step 53, go to step 55.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

What is claimed is:

1. A framing tool comprising:

an elongated guide having a stud side coupled to a nail side by an intermediate side;

the stud side, intermediate side, and nail side forming a substantially "n" shaped guide cross-section with an elongated slot;

the elongated slot for receiving a horizontal framing member;

the stud side including a plurality of pockets for receiving respective ends of vertical framing members;

the nail side including a plurality of nailing windows;

the guide being movable along an upper horizontal framing member of arbitrary length for aiding alignment and fixation of vertical framing members with the upper horizontal framing member;

the guide being movable along a lower horizontal framing member for aiding alignment and fixation of the vertical framing members with the lower horizontal framing member;

wherein the stud side is opposite the nail side;

wherein each pocket has three closed sides and an open side formed to orient sides of the vertical framing member at an angle with respect to the intermediate side;

plural first leveling devices, each first leveling device located between a respective pair of adjacent pockets in a first plane substantially parallel to the stud side for indicating a level of the guide;

each nailing window is generally opposed to a respective one of the stud side pockets; and, plural insets, each inset located between a respective pair of adjacent pockets.

2. The framing tool of claim 1 wherein each inset has a surface depressed with respect to the intermediate side and about parallel to the intermediate side.

3. The framing tool of claim 2 further including a second plurality of leveling devices located in a second plane at an angle with respect to the first plane.

4. The framing tool of claim 2 further including plural second leveling devices, a second leveling device fixed to each depressed surface for indicating a level of the guide.

5. The framing tool of claim 4 further including a plurality of viewing windows, each viewing window for exposing a junction between a respective vertical framing member and the horizontal framing member.

6. The framing tool of claim 5 further including a hinge coupling the intermediate side and the stud side, the hinge operable to facilitate sliding of the framing guide along a horizontal framing member.

7. A method of constructing a framed wall, the method comprising the steps of:

providing a framing guide with a stud side having stud pockets, a nailing side having nailing windows, an intermediate side adjoining the stud and nailing sides, and an open side for accessing an elongated slot between the stud and nailing sides;

providing a first plurality of leveling devices coupled to the stud side and a second plurality of leveling devices coupled to the intermediate side;

interengaging the elongated slot and a bottom horizontal framing member;

interengaging first ends of a plurality of vertical framing members with respective stud pockets;

fastening the first end of each vertical member to the bottom horizontal member;

relocating the guide and interengaging the elongated slot and a top horizontal framing member;

interengaging second ends of the plurality of vertical framing members with respective stud pockets;

fastening the second end of each vertical member to the top horizontal member;

turning up and locating the wall in its intended position in a structure;

using the guide leveling devices to orient the wall with respect to a foundation;

using the guide leveling devices to orient the wall with respect to an adjacent structural member;

fastening the wall to the foundation; and, fastening the wall to an adjacent structural member.

8. The method of claim 7 further including the steps of:

relocating the guide when the number of vertical framing members exceeds the number of stud pockets;

interengaging one of the stud pockets with a vertical framing member adjacent to where the next vertical framing member will be joined;

interengaging an end of the next vertical framing member with a respective one of the stud pockets; and, fastening the end of the next vertical framing member to the horizontal framing member.

9. The method of claim 8 further including the steps of:

articulating the stud side with respect to the intermediate side; and, rotating the stud side with respect to the intermediate side to facilitate sliding the guide.

* * * * *